US011808181B2

(12) United States Patent
Correa

(10) Patent No.: US 11,808,181 B2
(45) Date of Patent: Nov. 7, 2023

(54) EXHAUST VALVE OPENING SYSTEM

(71) Applicant: Cummins Inc., Columbus, IN (US)

(72) Inventor: Dixon Malcolm Correa, Columbus, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 17/655,209

(22) Filed: Mar. 17, 2022

(65) Prior Publication Data

US 2022/0205373 A1 Jun. 30, 2022

Related U.S. Application Data

(63) Continuation of application No. PCT/US2020/055683, filed on Oct. 15, 2020.

(60) Provisional application No. 62/915,336, filed on Oct. 15, 2019.

(51) Int. Cl.

| | |
|---|---|
| ***F01L 13/06*** | (2006.01) |
| ***F01L 1/18*** | (2006.01) |
| ***F01L 1/24*** | (2006.01) |
| ***F01L 1/26*** | (2006.01) |

(52) U.S. Cl.

CPC ..... *F01L 13/065* (2013.01); *F01L 1/181* (2013.01); *F01L 1/2416* (2013.01); *F01L 1/26* (2013.01); *F01L 2001/2444* (2013.01); *F01L 2760/004* (2013.01)

(58) Field of Classification Search

CPC ..... F01L 13/065; F01L 1/181; F01L 1/2416; F01L 1/26; F01L 2001/2444; F01L 2760/004; F01L 1/20; F01L 1/267; F01L 2001/0476; F01L 2001/0535; F01L 2305/00

See application file for complete search history.

(56) References Cited

U.S. PATENT DOCUMENTS

| | | | | |
|---|---|---|---|---|
| 3,908,033 | A | 9/1974 | Cartledge | |
| 5,680,841 | A | 10/1997 | Hu | |
| 5,937,807 | A | 8/1999 | Peters et al. | |
| 6,439,195 | B1 * | 8/2002 | Warner | F02D 13/0246 123/90.46 |
| 2004/0118368 | A1 | 6/2004 | Hefler | |
| 2008/0223325 | A1 | 9/2008 | Meistrick | |
| 2010/0251983 | A1 | 10/2010 | Meistrick et al. | |
| 2012/0024260 | A1 | 2/2012 | Groth et al. | |

FOREIGN PATENT DOCUMENTS

| | | | | |
|---|---|---|---|---|
| CN | 1985072 A * | 6/2007 | | F01L 1/181 |
| CN | 205876420 U | 1/2017 | | |
| DE | 102010016718 B4 * | 6/2014 | | F01L 1/181 |
| WO | 2008115424 A1 | 9/2008 | | |

OTHER PUBLICATIONS

International Search Report and Written Opinion, PCT Appln. No. PCT/US20/55683, dated Jan. 22, 2021, 7 pgs.

* cited by examiner

*Primary Examiner* — Hung Q Nguyen
(74) *Attorney, Agent, or Firm* — Taft Stettinius & Hollister LLP

(57) ABSTRACT

An exhaust valve opening apparatus such as for an engine compression braking system includes a rocker shaft for supplying control fluid to an controllable valve and for distributing the control fluid to a primary and second piston arrangement that selectively opens an exhaust valve in response to the control fluid being pressurized.

27 Claims, 14 Drawing Sheets

EXHAUST VALVE OPENING SYSTEM

CROSS-REFERENCE TO RELATED APPLICATIONS

The present application is a continuation of PCT Patent Application No. PCT/US20/55683 filed on Oct. 15, 2020, which claims the benefit of the filing date of U.S. Provisional Application Ser. No. 62/915,336 filed on Oct. 15, 2019, each of which is incorporated herein by reference in its entirety.

FIELD OF THE INVENTION

This invention relates to an exhaust valve opening apparatus such as for compression release braking or early exhaust valve opening operations that utilizes a primary-secondary piston arrangement to transfer motion from a cam lobe to an exhaust valve.

BACKGROUND

Exhaust valve opening devices are known and used for many applications, including compression braking for heavy vehicles and for early exhaust valve opening for combustion and thermal management. For example, compression braking converts an internal combustion engine cylinder to a compressor by opening an exhaust valve of the cylinder near the end of the compression stroke. This allows the power generated in the piston to escape to the atmosphere rather than continuing to power the crankshaft of the vehicle, and the use of service brakes can be minimized, extending their life. Examples of compression braking systems are shown in U.S. Pat. No. 6,253,730 to Gustafson and U.S. Pat. No. 9,249,698 to Gustafson et al., each of which are incorporated herein by reference.

An early technique for accomplishing compression braking is disclosed in U.S. Pat. No. 3,220,392 to Cummins, where a secondary hydraulic piston located over an exhaust valve opens the exhaust valve near the end of the compression stroke of an engine piston with which the exhaust valve is associated. To place the engine into braking mode, solenoid valves are energized which causes pressurized lubricating oil to flow through a control valve, creating a hydraulic link between a primary piston and a secondary piston. The primary piston is displaced inward by an engine element (such as a camshaft mechanism) periodically in timed relationship with the compression stroke of the engine.

A typical modern compression braking system may include exhaust valves operated during the engine's power mode by an exhaust rocker lever using a hydraulic primary-secondary piston arrangement. Other systems have also been developed, including a dedicated brake rocker lever, and an I-brake or other lost motion device enabled rocker levers.

Hydraulic compression braking systems are typically bulky due to the hydraulic system for operating the system being incorporated into a slab mounted on the engine. These and other arrangements are also relatively large in size and weight, making service more difficult and increasing overall engine package size. Therefore, further improvements in this technological area are desired.

SUMMARY

Systems, apparatuses, and methods are disclosed herein to improve a hydraulic exhaust valve opening system for compression braking and/or early exhaust valve opening. The proposed design seeks to combine the advantages of a hydraulic brake system with the package size and capability of a dedicated rocker brake system. The disclosed exhaust valve opening system is compact and provides a reduced engine height over current designs. The proposed system is also low in weight and can provide comparable braking power and improved flexibility with a dedicated cam lobe.

This summary is provided to introduce a selection of concepts that are further described below in the illustrative embodiments. This summary is not intended to identify key or essential features of the claimed subject matter, nor is it intended to be used as an aid in limiting the scope of the claimed subject matter. Further embodiments, forms, objects, features, advantages, aspects, and benefits shall become apparent from the following description and drawings.

DETAILED DESCRIPTION

Figure 1:
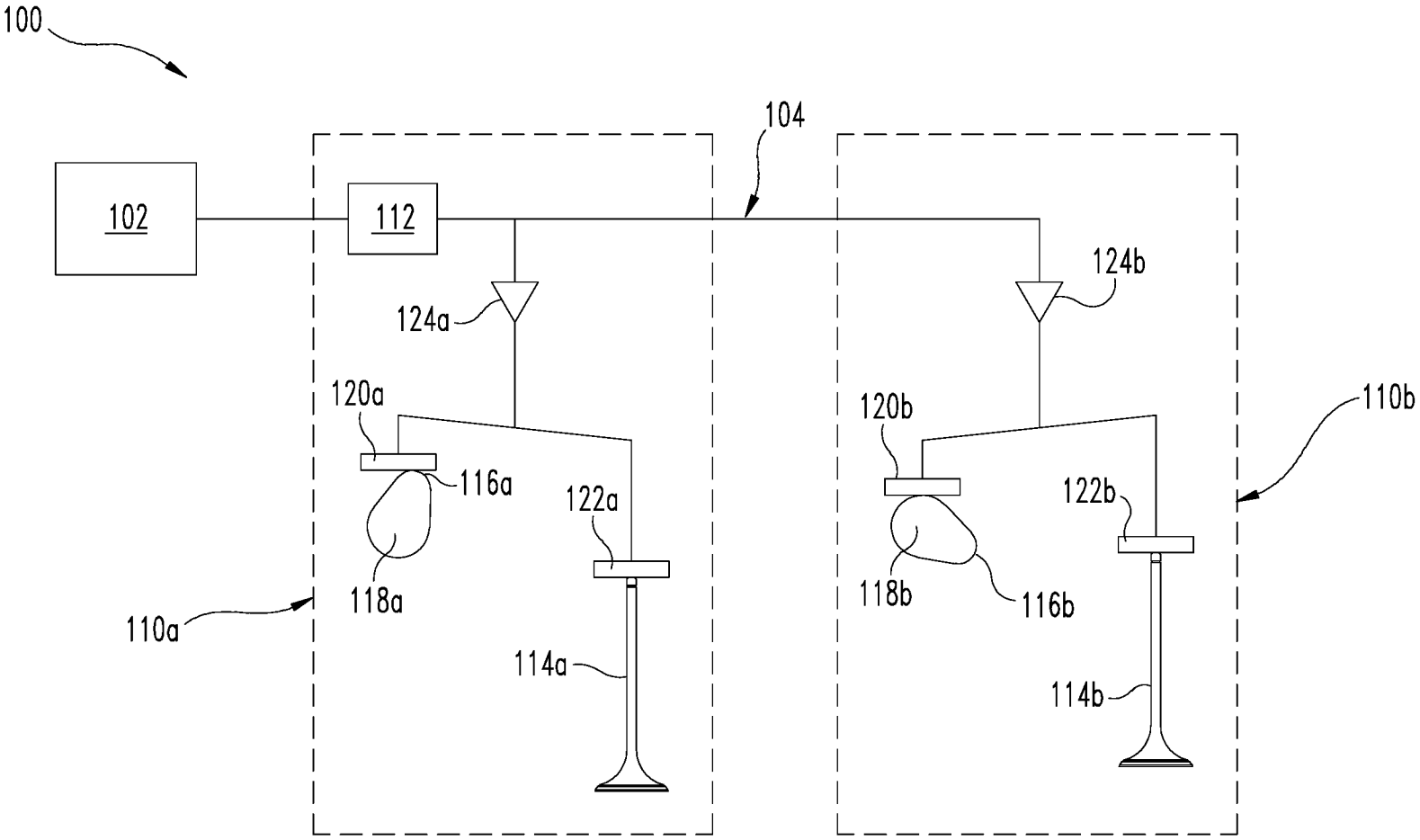
FIG. 1 is a schematic illustration of one embodiment of an exhaust valve opening system according to the present disclosure.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

Referring to FIG. 1, an exhaust valve opening system 100 includes a control fluid supply 102 that is operable to supply a control fluid to a first housing assembly 110*a* and a second housing assembly 110*b* to open first and second exhaust valves 114*a*, 114*b*. In particular, when enabled by system 100, cam lobes 116*a*, 116*b* of the corresponding cam shafts 118*a*, 118*b* act on first and second primary pistons 120*a*, 120*b* to displace respective first and second secondary pistons 122*a*, 122*b* that are connected respective ones of the first and second exhaust valves 114*a*, 114*b*, thus opening and closing the exhaust valves 114*a*, 114*b*.

System 100 includes a controllable valve 112, such as a solenoid valve, as part of a first housing assembly 110*a* that receives the control fluid from a rocker shaft 104 fluidly connected to the control fluid supply 102. The controllable valve 112 is operable to pressurize the control fluid and provide the control fluid to first check valve 124*a* of the first housing assembly 110*a* and, through the rocker shaft 104, to a second check valve 124*b* of a second housing assembly 110*b*.

First check valve 124*a* receives the pressurized control fluid from controllable valve 112 therethrough so that in response to the cam lobe 116*a* displacing the first primary piston 120*a*, a corresponding displacement of first secondary piston 122*a* is provided that opens first exhaust valve 114*a*. Second check valve 124*b* receives the pressurized control fluid from controllable valve 112 via the rocker shaft 104 and prevents reverse flow so that in response to the cam lobe 116*b* displacing the second primary piston 120*b*, a corresponding displacement of the second secondary piston 122*b* is provided that opens second exhaust valve 114*b*.

Figure 2:
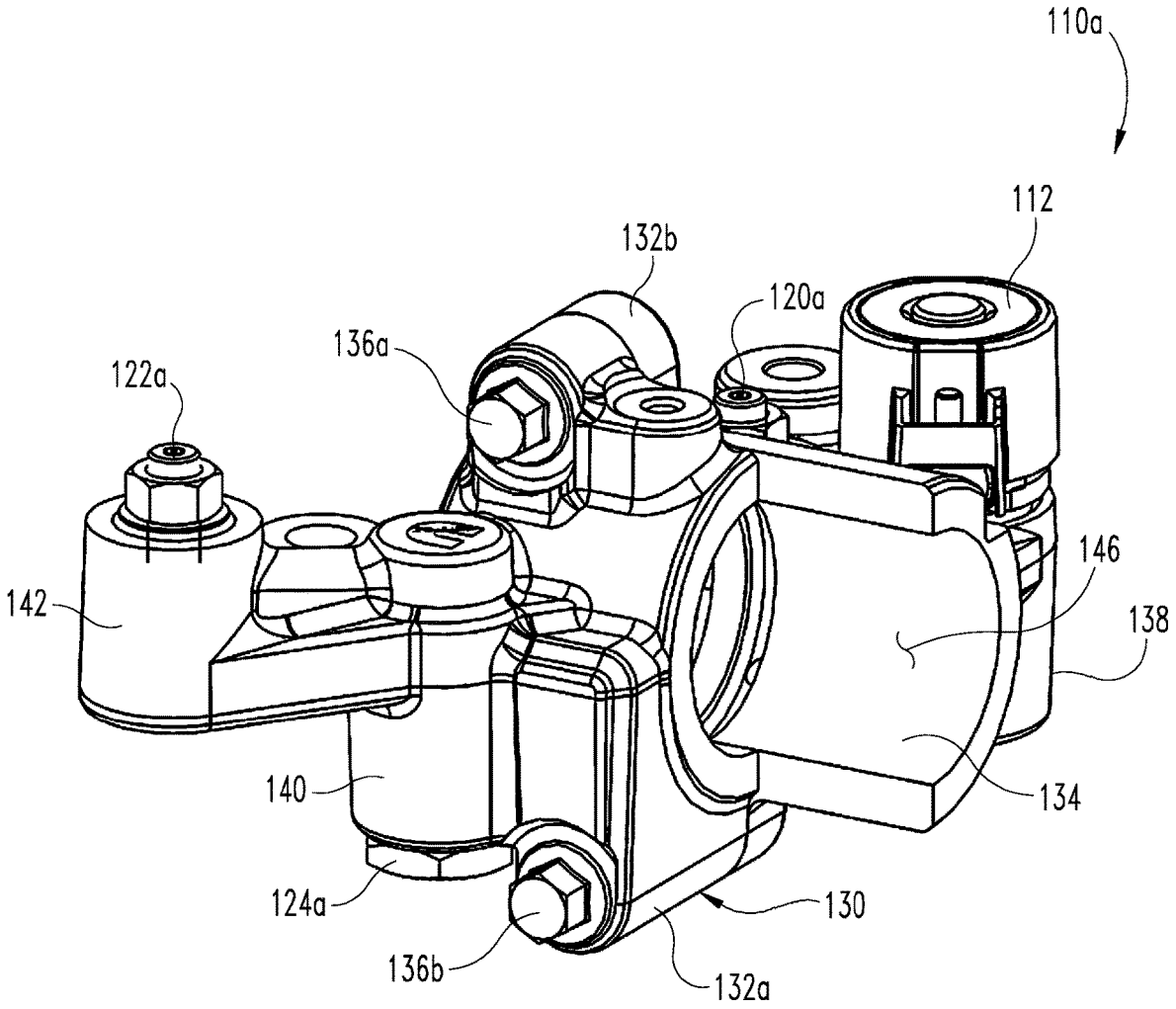
FIG. 2 is a perspective view of a housing assembly of the exhaust valve opening system of FIG. 1.
Figure 3:
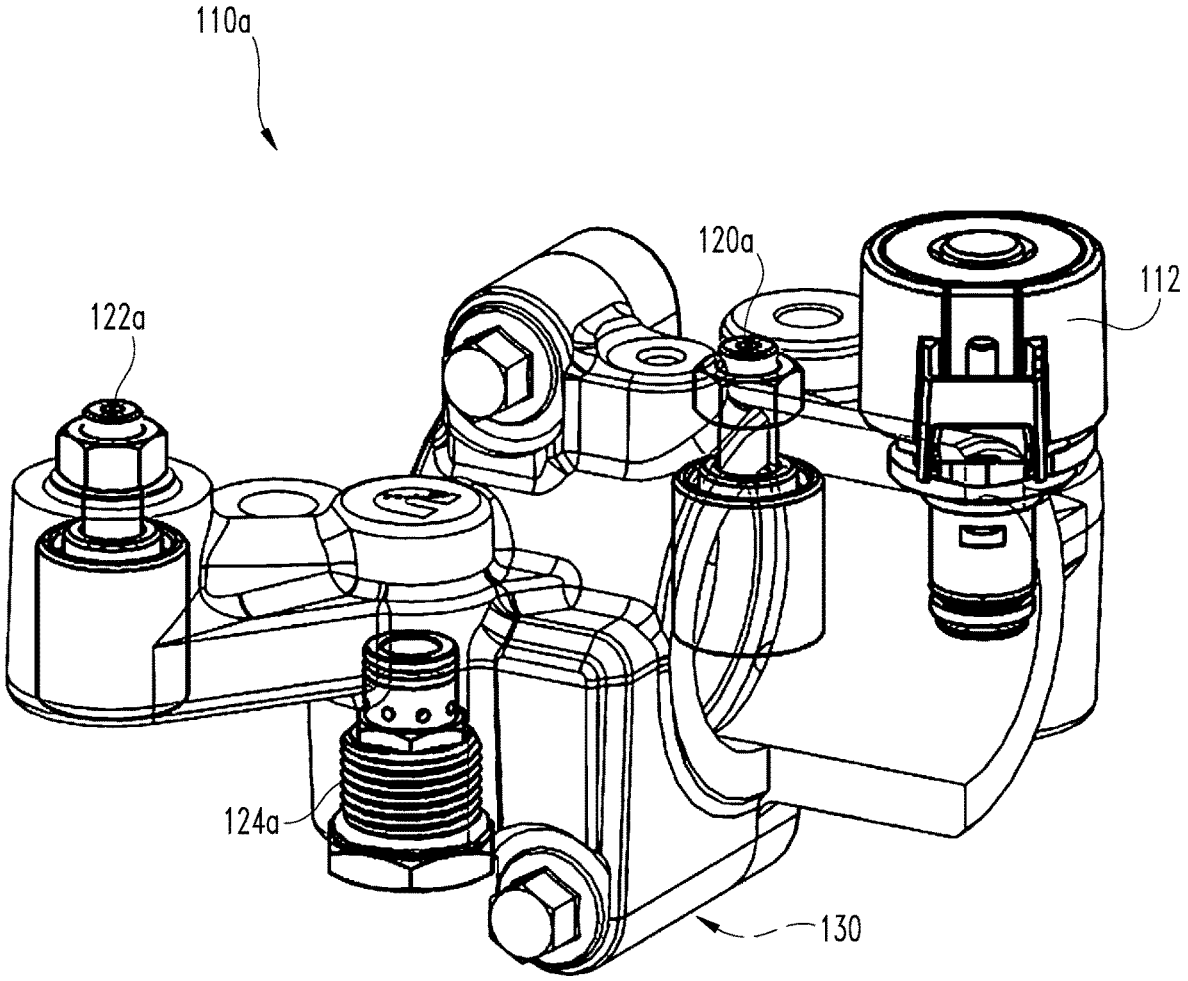
FIG. 3 is a perspective view of the housing assembly of FIG. 2 showing various components supported on the housing assembly.
Figure 4:
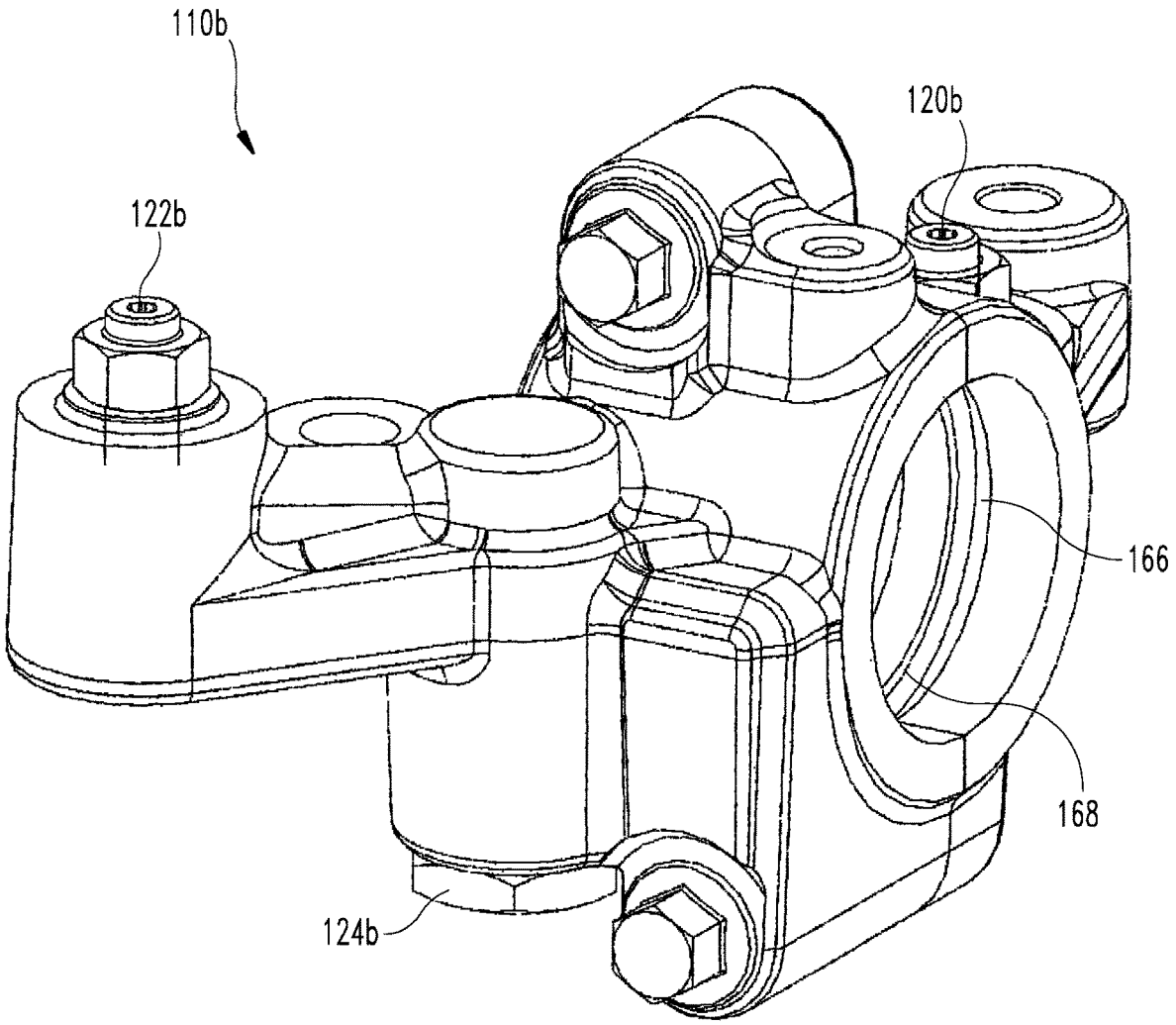
FIG. 4 is a perspective view of a second housing assembly of the exhaust valve opening system of FIG. 1.

FIGS. 2 and 3 illustrate an embodiment of a housing for the first housing assembly 110*a*. As shown in FIG. 4, it should be understood that the housing for second housing assembly 110*b* can be identical, except the second housing of housing assembly 110*b* need not include a controllable valve 112 and the flow paths associated therewith.

Housing assembly 110*a* includes a housing 130 that includes a first part 132*a* and a second part 132*b* that are coupled together to form a cylindrical compartment 134 for receiving the rocker shaft 104 therethrough. First and second fasteners 136*a*, 136*b* can be used to secure the first and second parts 132*a*, 132*b* of the housing 130 together. In other embodiments, housing 130 can be a single, integral component, or formed from more than two assembled parts.

Housing 130 includes a controllable valve pedestal 138 configured to receive and support controllable valve 112 therein. As mentioned above, the housing of second housing assembly 110*b* need not be provided with a controllable valve pedestal. Housing 130 also includes a check valve pedestal 140 configured to receive and support first check valve 124*a*. Housing 130 further includes a first piston pedestal 142 configured to receive and support primary piston 120*a*, and a second piston pedestal 144 configured to receive and support secondary piston 122*a*.

Figure 5:
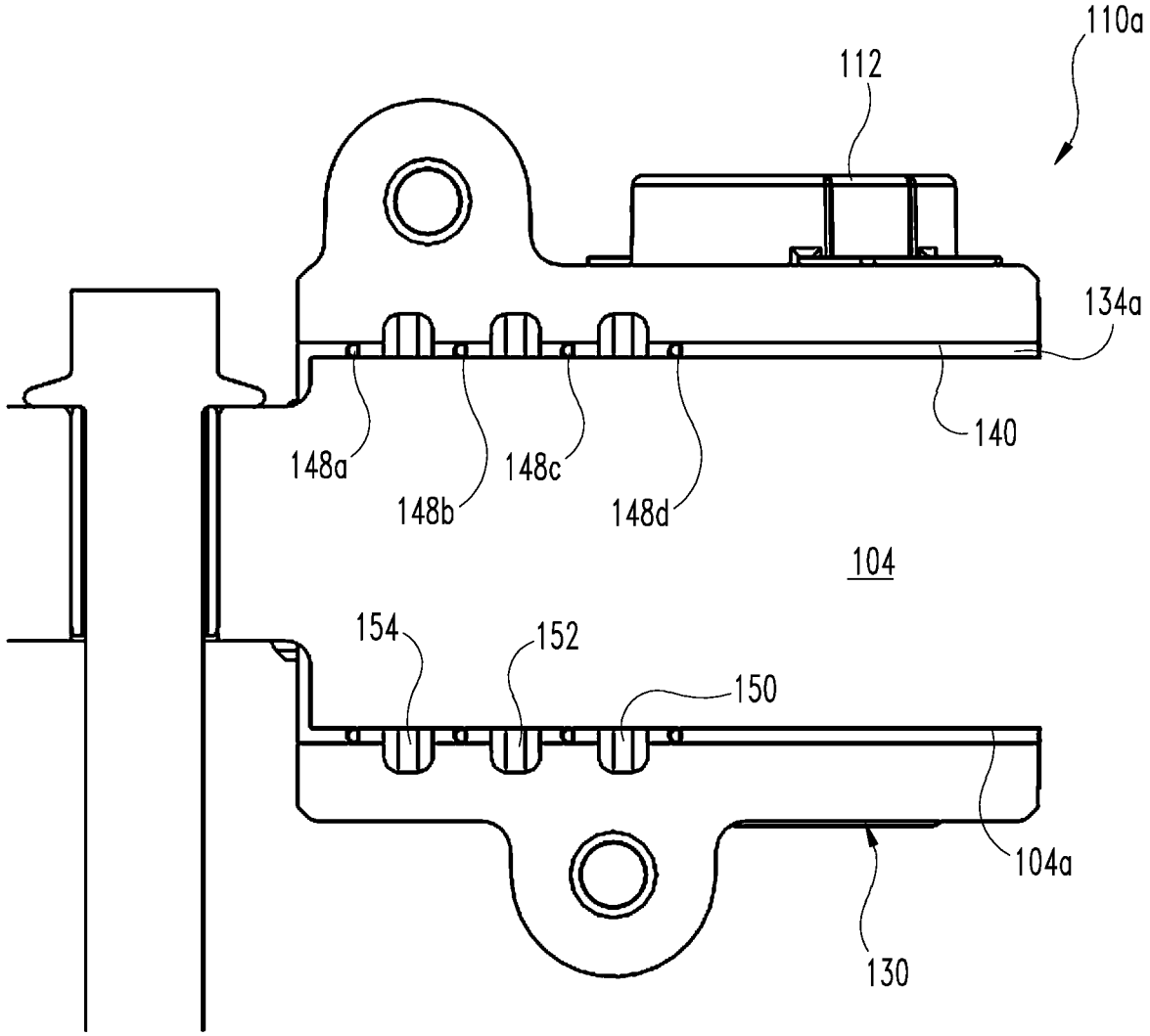
FIG. 5 is a partial cross-sectional view of the housing assembly of FIG. 2.

Referring further to FIG. 5, housing 130 includes an inner surface 146 extending around a cylindrical compartment 134 that receives the rocker shaft 104. Housing 130 includes a first annular groove 150, a second annular groove 152, and a third annular groove 154, each formed in inner surface 146. The housing for second housing assembly 110*b* need not include annular groove 150 since, as discussed further below, it is provided for the controllable valve 112, which is absent from the second housing assembly 110*b*.

A number of annular seals 148*b*, 148*c* can also be provided between each of the annular grooves 150, 152, 154 to seal and fluidly isolate the annular grooves 105, 152, 154 from one another. Seals 148*a*, 148*d* can also be provided at the outer sides of the annular grooves 150, 154 to seal and fluidly isolate each groove 150, 152, 154 from the exterior environment. The seals 148*a*, 148*b*, 148*c*, 148*d* each extend between and sealing engage the inner surface 146 of housing 130 and an outer surface 104*a* of rocker shaft 104.

Figure 7:
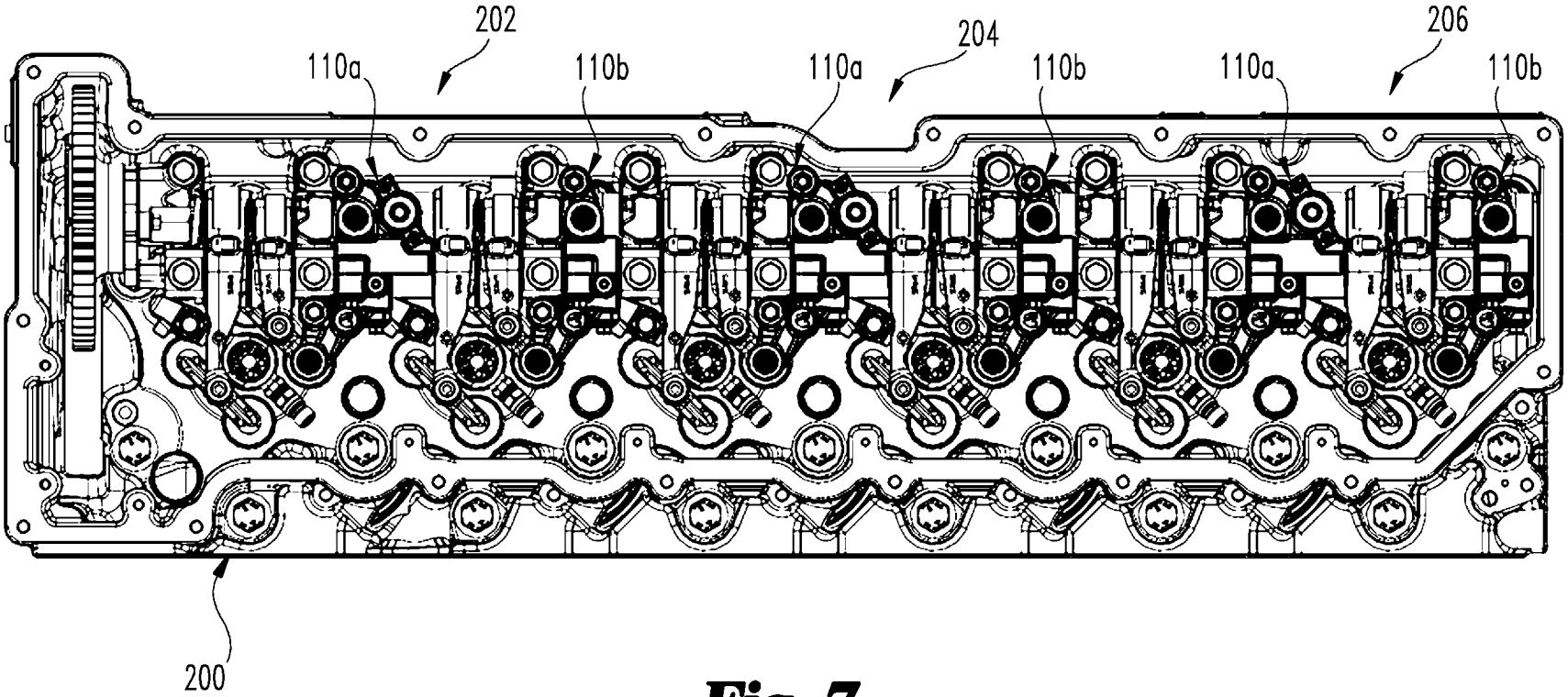
FIG. 7 is a plan view of one implementation of the of the exhaust valve opening system of FIG. 1.

Housings 110*a*, 110*b* can be mounted to either the cylinder, head, cam carrier, or cam caps, such as shown in FIG. 7, with a gap 134*a* between inner surface 146 and outer surface 104*a* of rocker shaft 104, as shown in FIG. 5. This arrangement prevents the transfer of braking loads to the rocker shaft 104 during braking operations or during the exhaust valve opening.

Figure 6:
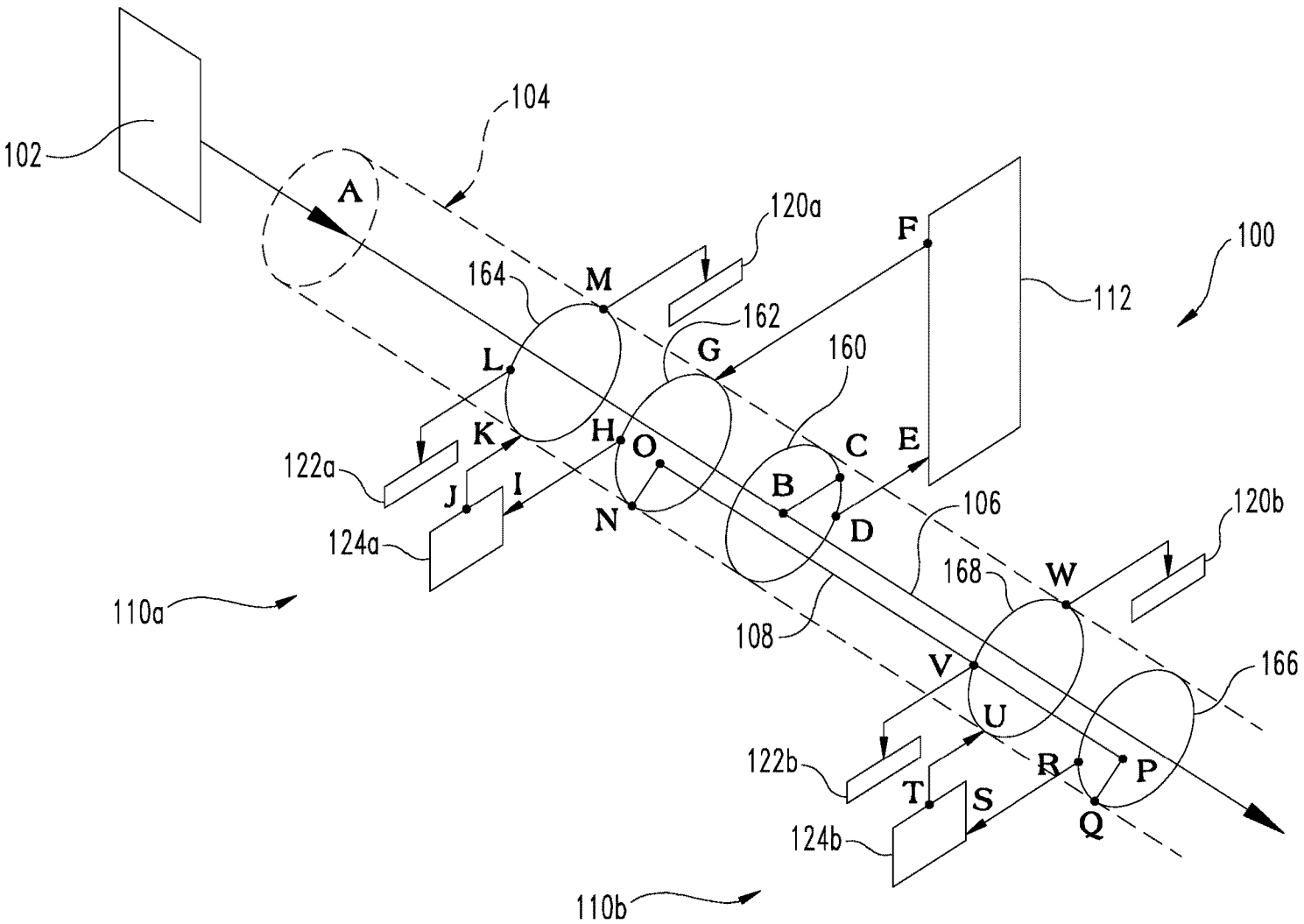
FIG. 6 is a schematic illustration of the fluid flow paths through a rocker shaft of the exhaust valve opening system of FIG. 1 to supply control fluid to the various components of the housing assembly.

Referring to FIG. 6, the arrangement of the control fluid delivery circuit to the components of the housing assemblies 110*a*, 110*b* will be described. Rocker shaft 104 includes a controllable valve flow path 106 and a second check valve flow path 108, each extending longitudinally therethrough. Controllable valve flow path 106 is connected at point A to control fluid supply 102 to provide the control fluid to controllable valve 112 to control the exhaust valve opening operation.

Controllable valve flow path 106 extends to point B in rocker shaft 104, which is connected to a radial flow path in rocker shaft 104 that is connected to point C at a first annular flow passage 160 between rocker shaft 104 and housing 130. First annular flow passage 160 can be formed by, for example, first annular groove 150 of housing 130 discussed above. First annular flow passage 160 is in fluid communication with a flow path in housing 130 that extends from point D to an inlet E of controllable valve 112.

Controllable valve 112 includes an outlet at point F that is connected to second annular flow passage 162 at point G such as by another flow path in housing 130. Second annular flow passage 162 is formed between housing 130 and rocker shaft 104, such as by second annular groove 152, as discussed above.

First check valve 124*a* receives control fluid from second annular flow passage 162 at a check valve inlet I. Check valve inlet I is connected to second annular flow passage 162 at point H with another flow path in housing 130 that extends therebetween. Check valve 124*a* includes an outlet J that is connected to third annular flow passage 164 at point K with another flow path in housing 130 that extends therebetween.

Third annular flow passage 164 is formed between housing 130 and rocker shaft 104, such as by third annular groove 154, as discussed above. Third annular flow passage 164 is connected to first primary piston 120*a* at point L and to first secondary piston 122*a* at point M with associated flow paths in housing 130 that extend from the associated piston 120*a*, 122*a* and corresponding points L and M of the third annular flow passage 164.

Second annular flow passage 162 is also in fluid communication with second check valve flow path 108 with a radial flow path in rocker shaft 104 extending from point N on second annular flow passage 164 to an inlet O of second check valve flow path 108. Second check valve flow path 108 extends longitudinally along rocker shaft 104 from inlet O to an outlet P. Outlet P is connected to fourth annular flow passage 166 at second housing assembly 110*b* at point Q with another radial flow path in rocker shaft 104.

Fourth annular flow passage 166 is connected to an inlet S of second check valve 124*b* with another flow path in the second housing of housing assembly 110*b* that extends from the inlet S to point R on fourth annular flow passage 166. Outlet T of second check valve 124*b* is connected to point U of a fifth annular flow passage 168. Fifth annular flow passage 168 is connected at points V and W on fifth annular flow passage 168 to flow passages in the housing of second housing assembly 110*b* that are in fluid communication with second primary piston 120*b* and second secondary piston 122*b*.

Fourth and fifth annular flow passages 166, 168 can be formed by annular grooves in an inner surface of the housing of the second housing assembly 110*b*, such as described above with respect to annular grooves 162, 164 of housing 130. Seals can be provided between and on the outer sides of the grooved to fluidly isolate the fourth and fifth flow passages 166, 168.

Various applications of the present disclosure are contemplated. For example in FIG. 7 there is shown an arrangement that includes three sets of exhaust valve opening systems 100 for a six cylinder engine 200. A first set 202 is associated with first and second cylinders of engine 200, a second set 204 is associated with third and fourth cylinders of engine 200, and a third set 206 is associated with fifth and sixth cylinders of engine 200. Each of the exhaust valve opening systems 100 of sets 202, 204, 206 is controlled with control fluid provided from the control fluid supply 102 via a rocker shaft 104 that extends along the engine 200 between the respective housings 110*a*, 110*b* of each of the first, second, and third sets 202, 204, 206. The arrangement of three sets of exhaust valve opening systems for a six cylinder engine such as shown in FIG. 7 is also applicable to exhaust valve opening system 300 discussed below. Other embodiments for exhaust valve opening systems 100, 300 contemplate implementation with engines having more or fewer than six cylinders.

Other applications of one or more aspects of the present disclosure are also contemplated. For example, the rocker shaft 104 with the control fluid supply passages can be provided with other types of housing assemblies, such as with the cam housing 350 discussed further below. In another example, the housing assemblies 110*a*, 110*b* and/or the cam housing 350 can also be employed with other types of rocker shafts. In addition, the system 100 need not be provided with two housing assemblies 110*a*, 110*b*, but rather can be implemented with a single housing assembly 110*a*. However, implementation with two housing assemblies 110*a*, 110*b* allows a single controllable valve to be used to control two exhaust valves.

Figure 8:
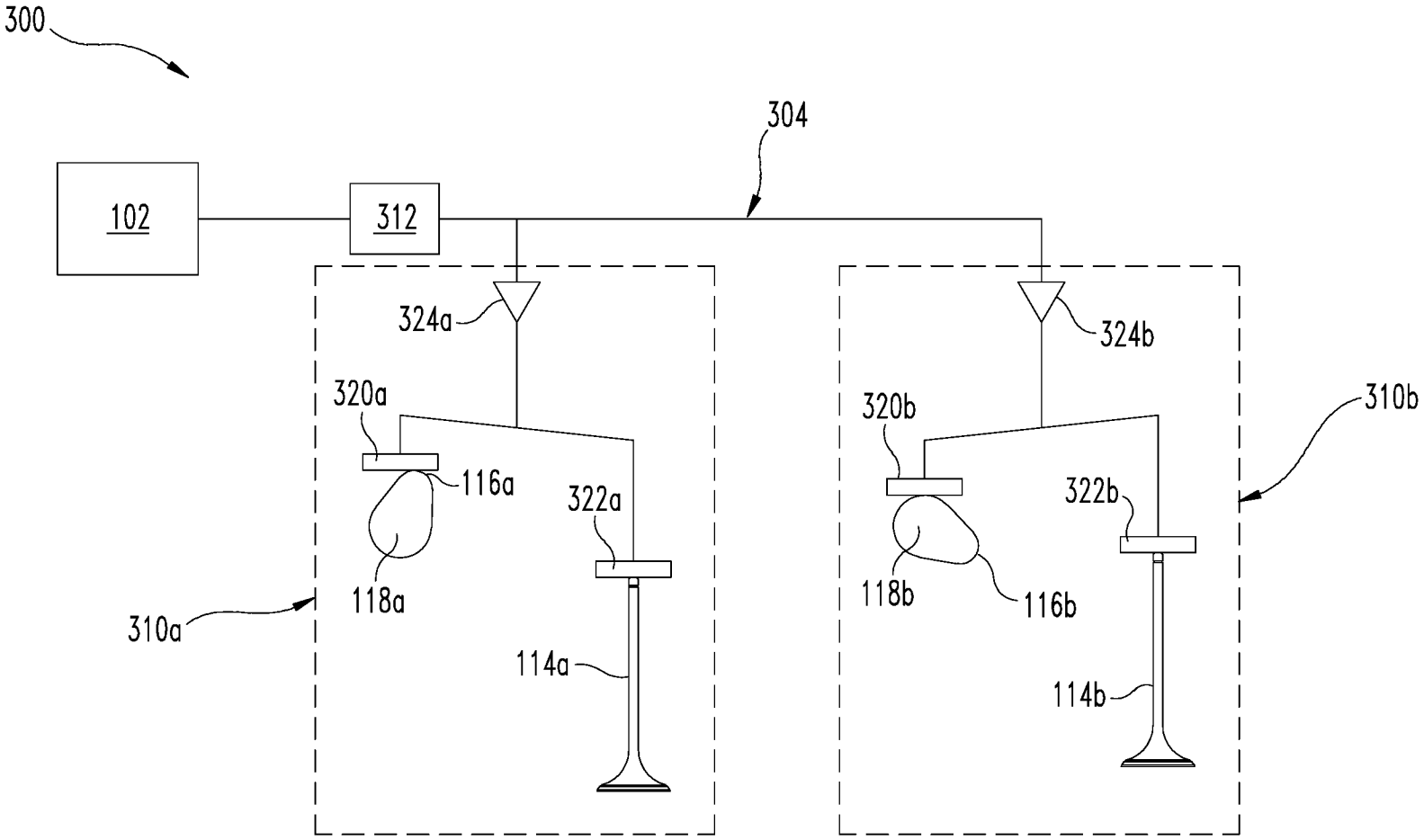
FIG. 8 is a schematic illustration of another embodiment of an exhaust valve opening system according to the present disclosure.

Referring to FIG. 8, another embodiment exhaust valve opening system 300 includes control fluid supply 102, such as discussed above, that is operable to supply a control fluid to a first cam housing part 310*a* and a second cam housing part 310*b* to open first and second exhaust valves 114*a*, 114*b*. In particular, when enabled by system 300, cam lobes 116*a*, 116*b* of the corresponding cam shafts 118*a*, 118*b* act on first and second primary pistons 320*a*, 320*b* to displace respective first and second secondary pistons 322*a*, 322*b* that are connected respective ones of the first and second exhaust valves 114*a*, 114*b*, thus opening and closing the exhaust valves 114*a*, 114*b*.

System 300 includes a controllable valve 312, such as a solenoid valve, that is mounted to the rocker shaft 304 and receives the control fluid from a passage of the rocker shaft 304, which is fluidly connected to the control fluid supply 102. The controllable valve 312 is operable to pressurize the control fluid and provide the control fluid, through another passage of the rocker shaft 304, to first check valve 324*a* of the first cam housing part 310*a* and, through the passage of the rocker shaft 304, to a second check valve 324*b* of the second cam housing part 110*b*.

First check valve 324*a* receives the pressurized control fluid from controllable valve 312 for passage therethrough so that in response to the cam lobe 116*a* displacing the first primary piston 320*a*, a corresponding displacement of first secondary piston 322*a* is provided that opens first exhaust valve 114*a*. Second check valve 324*b* receives the pressurized control fluid from controllable valve 312 via the rocker shaft 304 and prevents reverse flow so that in response to the cam lobe 116*b* displacing the second primary piston 320*b*, a corresponding displacement of the second secondary piston 322*b* is provided that opens second exhaust valve 114*b*.

Figure 9:
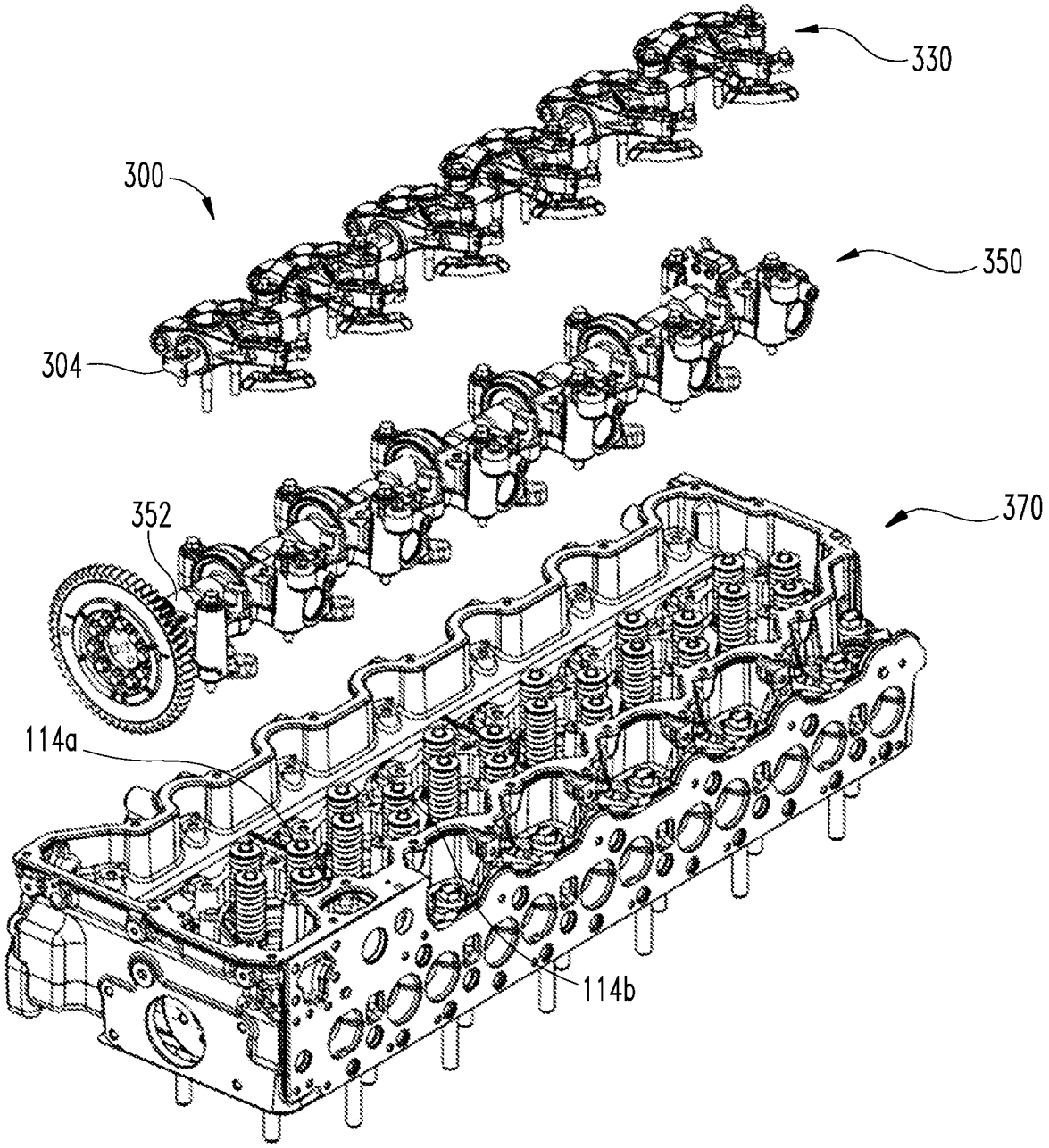
FIG. 9 is an exploded perspective view of the exhaust valve opening system of FIG. 8.

Referring to FIG. 9, the exhaust valve opening system 300 includes a rocker lever assembly 330 that houses the rocker levers of the engine along with rocker shaft 304. Exhaust valve opening system 300 further includes a cam housing assembly 350 that includes a cam housing 354 for housing a cam shaft 352 that carries the cam lobes 116*a*, 116*b*. Exhaust valve opening system 300 also includes a cylinder head assembly 370 that is mountable to the engine block to support first and second exhaust valves 114*a*, 114*b*, along with the intake valves and other components, in the desired configuration relative to the respective engine cylinders.

Figure 10:
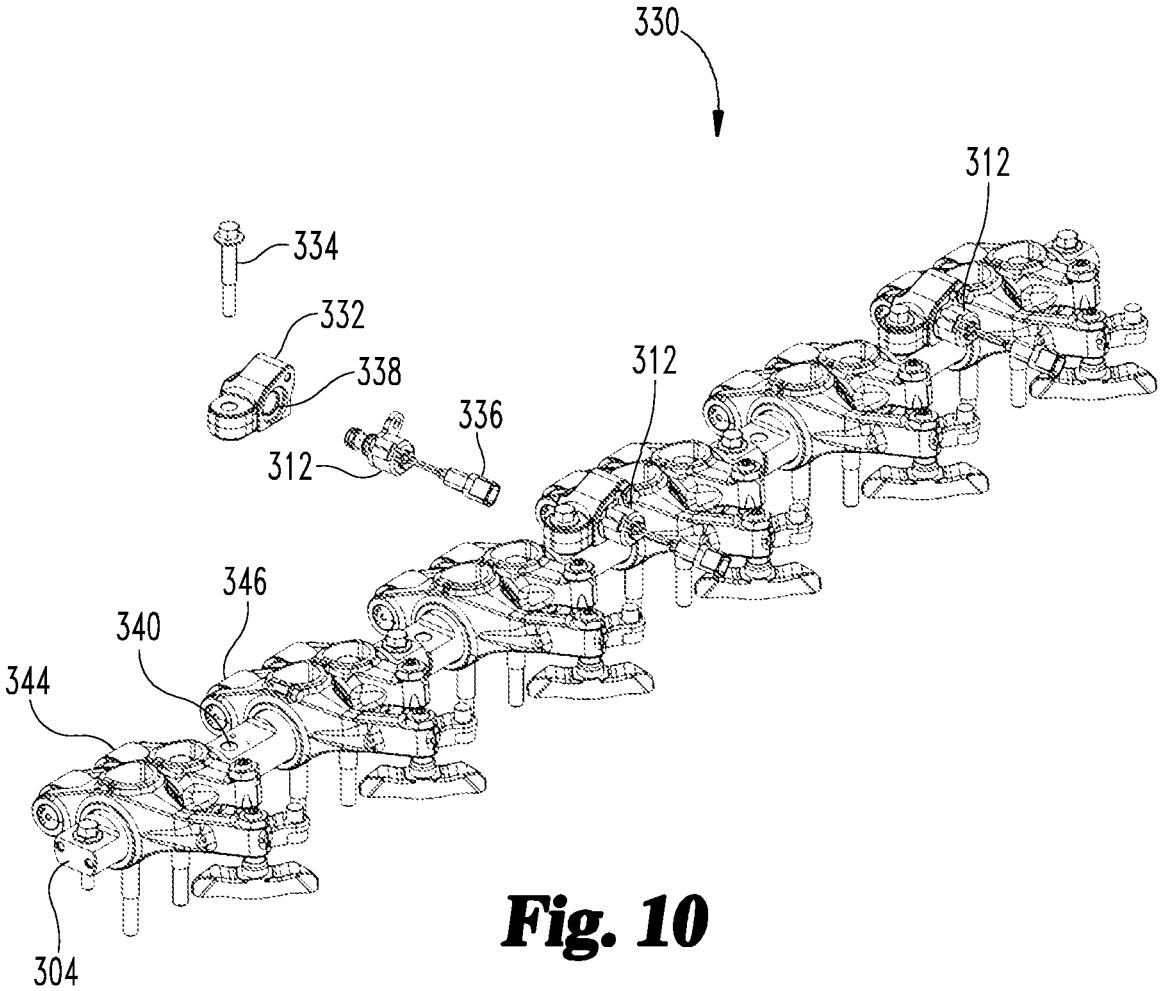
FIG. 10 is an exploded perspective view of a rocker lever assembly of the exhaust valve opening system of FIG. 8.

Referring to FIG. 10, rocker lever assembly 330 is shown with controllable valves 312, one of which is in an exploded view. Controllable valves 312 are mounted to rocker shaft 304 so that each controllable valve 312 is spaced along rocker shaft 304 and is associated with a respective pair of exhaust valves 114*a*, 114*b* of a pair of cylinders. In one embodiment, a valve housing 332 is fastened to rocker shaft 304 with a fastener 334 in hole 340 of rocker shaft 304 between rocker levers 344, 346. Embodiments without a valve housing 332 are also contemplated. As discussed further below, rocker shaft 304 includes flow passages to provide control fluid to and from controllable valve 312. Valve housing 332 includes a receptacle 338 to receive controllable valve 312. Each controllable valve 312 also includes a wiring harness 336 for engagement to a control system that provides signal to activate and deactivate controllable valve 312 to selectively supply pressurized control fluid.

Figure 11:
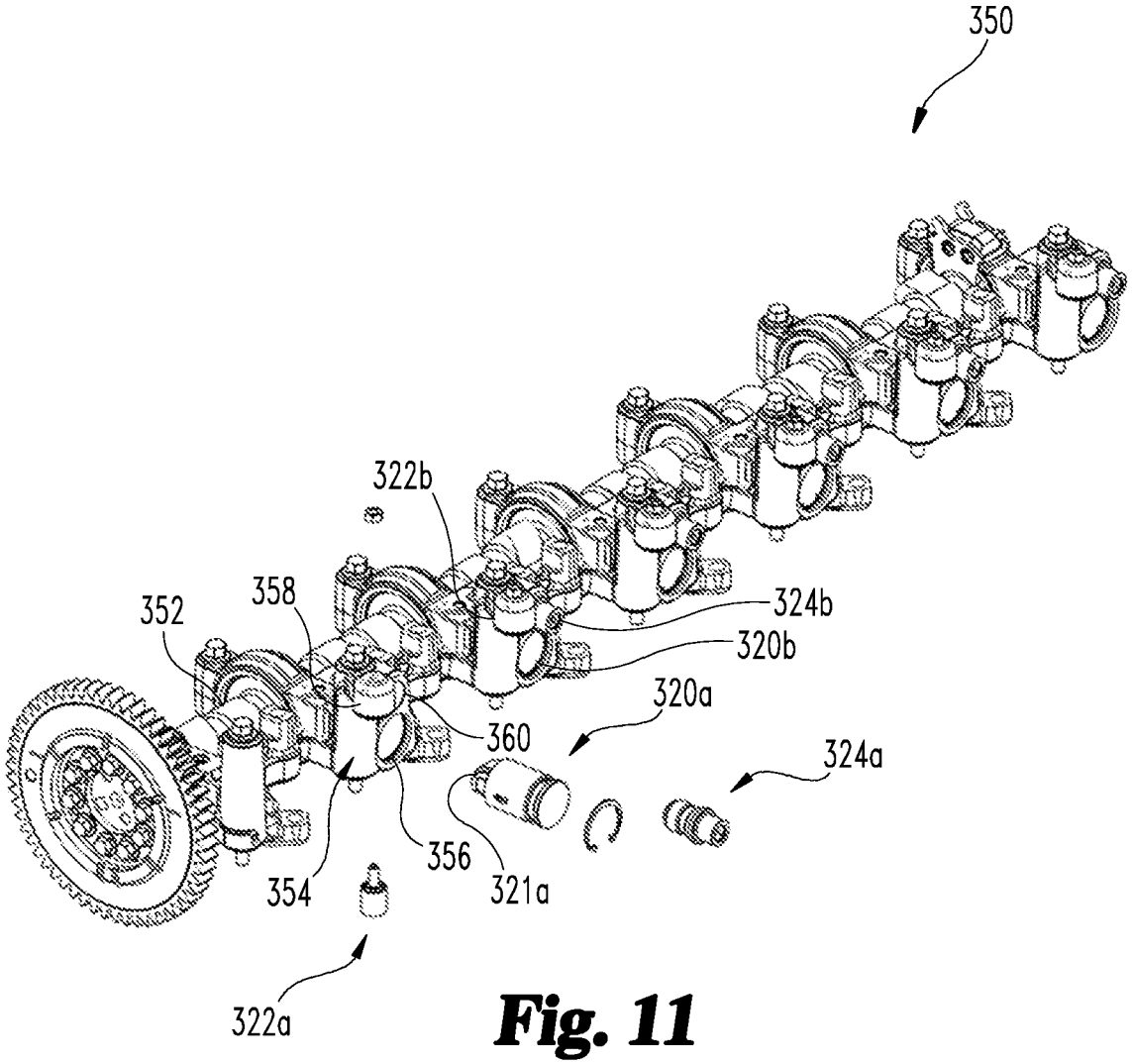
FIG. 11 is an exploded perspective view of a cam housing assembly of the exhaust valve opening system of FIG. 8.

Referring to FIG. 11, cam housing assembly 350 is shown with check valve 324*a*, primary piston 320*a*, and secondary piston 322*a* in an exploded view. First primary piston 320*a* is engaged in a first receptacle 356 of cam housing 354, such as shown with second primary piston 320*b*. The end 321*a* of primary piston 320*a* may include a roller or other member to contact the cam lobe 116*a*. When the control fluid de-energized, the primary piston 320*a* is configured to collapse in response to passage of the cam lobe 116*a* thereagainst, but is configured to be locked by the control fluid to prevent collapse when exhaust valve opening is desired. First secondary piston 322*a* is engaged in a second receptacle 358 of cam housing 354, such as shown with second secondary piston 322*b*. First check valve 324*a* is engaged in third 360 of cam housing 354, such as shown with second check valve 324*b*.

Figure 12:
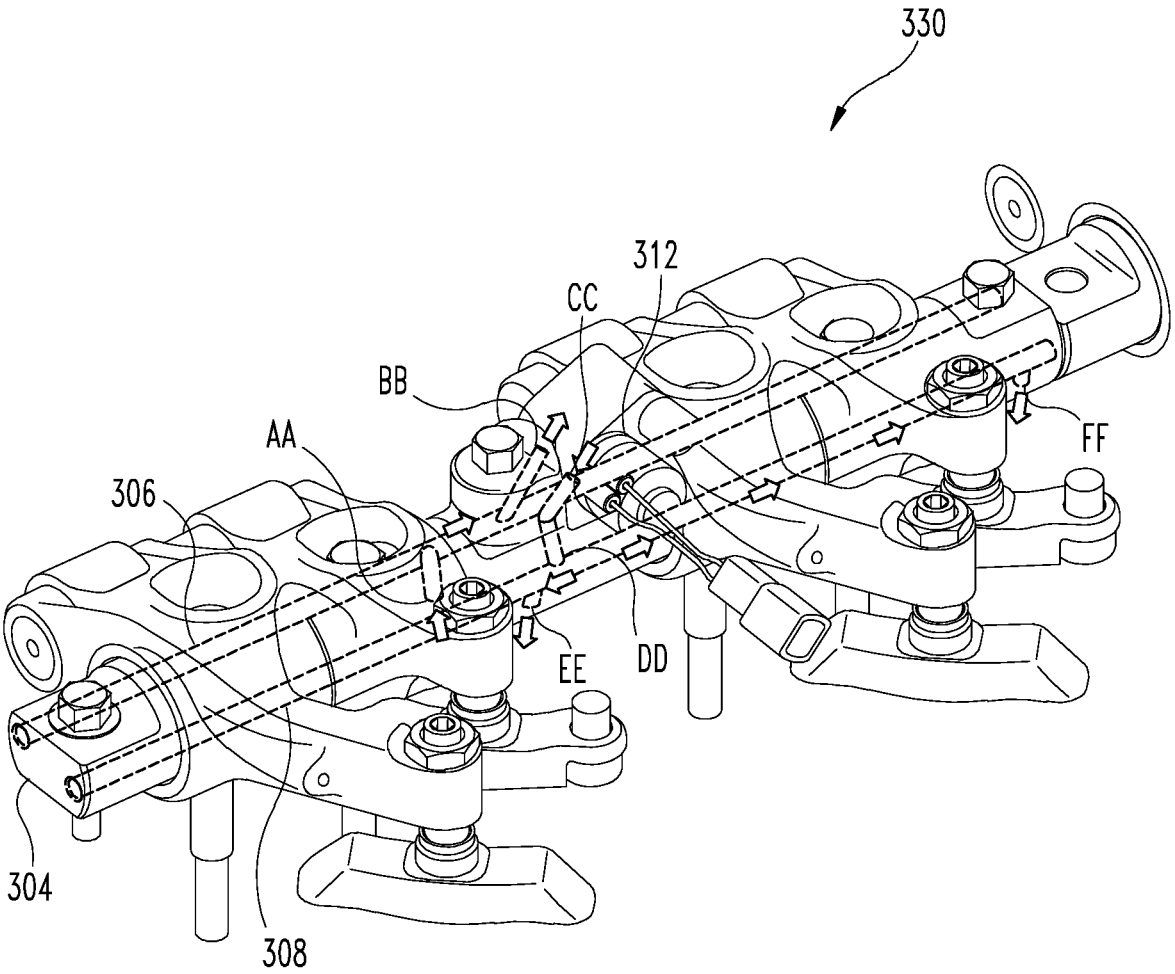
FIG. 12 is a schematic illustration of the fluid flow paths through a rocker shaft of the exhaust valve opening system of FIG. 8 to supply control fluid to the cam housing assembly.

FIG. 12 shows a schematic of the arrangement of the control fluid delivery circuit to check valves 324*a*, 324*b* via rocker shaft 304. Rocker shaft 304 includes a controllable valve flow path 306 and a check valve flow path 308, each extending longitudinally through rocker shaft 304 with transverse portions to provide the necessary flow path connections. Controllable valve flow path 306 is connected at point AA to control fluid supply 102 to provide the control fluid to controllable valve 312 at inlet BB.

In response to a command or operation of open the exhaust valves 114*a*, 114*b*, controllable valve 312 is energized to pressurize the control fluid. Controllable valve 312 includes an outlet CC that is connected to check valve flow path 308 at point DD in rocker shaft 104. Check valve flow path 308 extends to and is connected to first check valve 324*a* at point EE and to second check valve 324*b* at point FF to deliver pressurized control fluid to the check valves 324*a*, 324*b* mounted to the cam housing 354, as discussed above.

Figure 13:
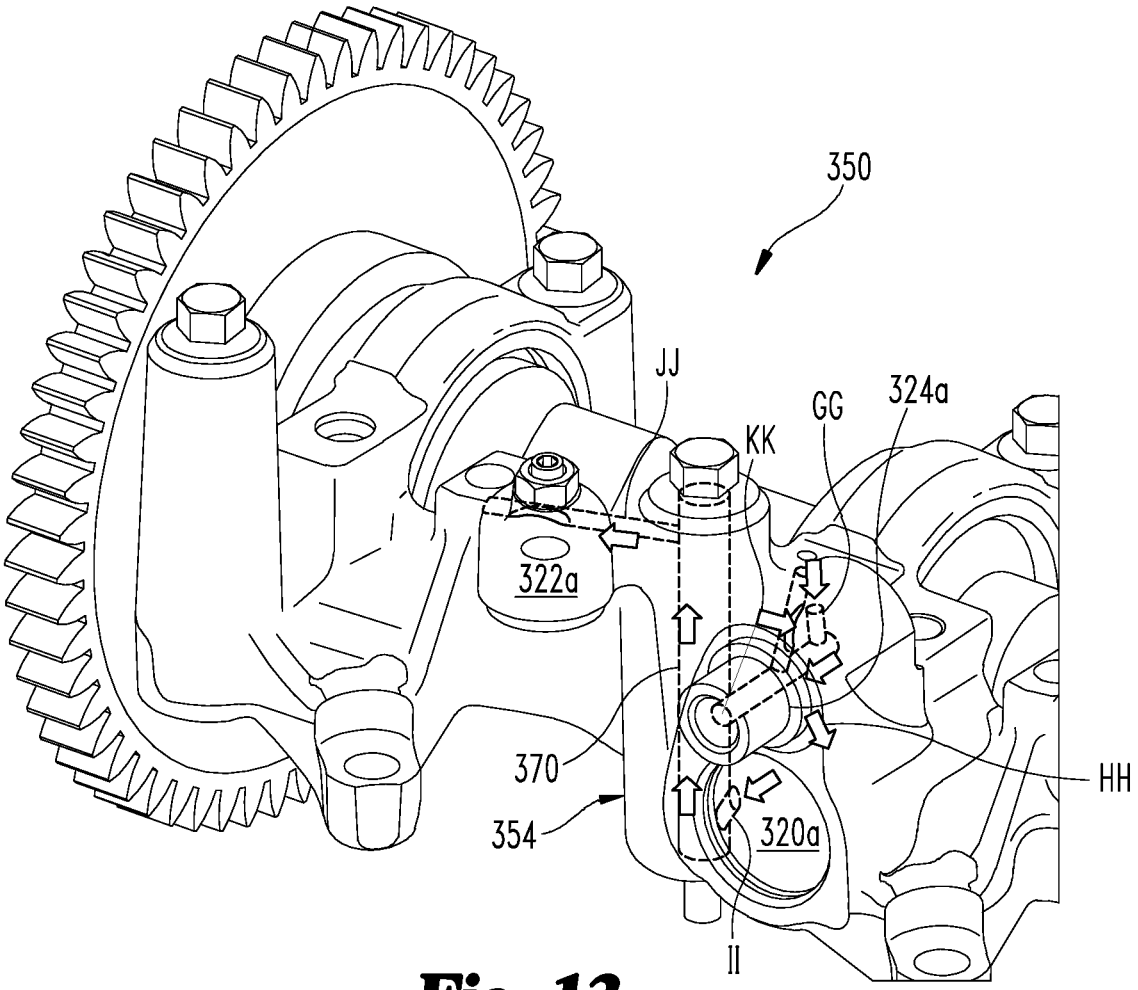
FIG. 13 is a schematic illustration of the fluid flow paths in the cam housing assembly of the exhaust valve opening system of FIG. 8 to receive control fluid from the rocker shaft of FIG. 12 and supply control fluid to the various components of the cam housing assembly.

Referring to FIG. 13, the flow path in the cam housing 354 for one check valve 324*a* is shown, it being understood the flow paths in cam housing 354 for the other check valves can be similarly configured. Cam housing 354 receives control fluid from rocker shaft 304 at inlet GG to the check valve 324*a*. Pressurized control fluid exits check valve 324*a* and is provided to primary cylinder 320*a* at point HH. Pressurized control fluid is further provided from primary cylinder 320*a* at an outlet II to a cam housing flow passage 370. Cam housing flow passage 370 extends longitudinally to provide control fluid to an inlet JJ of secondary piston 322*a*. When controllable valve 312 is de-energized, control fluid can bleed back through check valve 324*a* at bleed outlet KK to allow the exhaust valves 114*a*, 114*b* to rapidly close.

Figure 14A:
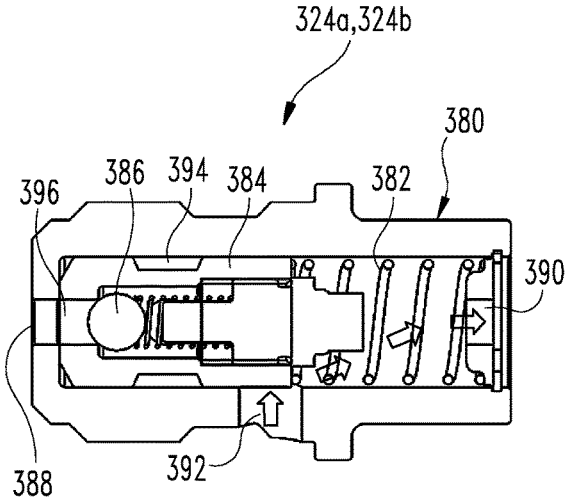
FIGS. 14A and 14B are cross-sectional views of a check valve of the exhaust valve opening system of FIG. 8.
Figure 14B:
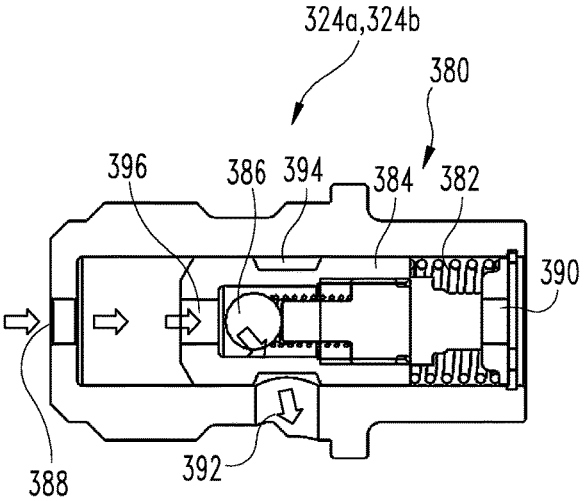

FIGS. 14A-14B show an embodiment of check valves 324*a*, 324*b* that is configured to allow pressurized control fluid to bleed back therethrough in response to controllable valve 312 being de-energized. This embodiment check valve includes a cylindrical housing body 380 with a central cavity for housing a spring 382, a first valve part 384, and a second valve part 386. First valve part 384 includes a recessed side hole(s) 394 therethrough. Housing body 380 includes an inlet 388 at one end thereof and an outlet 390 at the opposition end thereof. Housing body 380 further includes at least one hole 392 in the side thereof.

In FIG. 14B check valve 324*a*, 324*b* is opened since pressurized control fluid compresses spring 382 to unseat first valve part 384 from inlet 388 and unseat second valve part 386 from end opening 396 of first valve part 384. This allows control fluid to flow into the cavity of housing body 380, through the end opening 396 of first valve part 382, and out of the aligned holes 392, 394 to the primary piston 320*a*. The outlet 390 of housing body 380 is simultaneously closed by second valve part 386.

In FIG. 14A the controllable valve 312 is de-energized and the control fluid is not actively pressurized, allowing first valve part 384 to seat against housing body 380 and second valve part 386 to seat against end opening 396 via spring 382, preventing control fluid from entering housing body 380. However, hole 392 is only partially obstructed by first valve part 384, allowing fluid to flow back into the housing cavity through hole 392 and through the outlet 390, allowing the pressure from the control fluid to bleed from primary piston 320*a* to the oil sump so that the exhaust valve is no longer opened by the exhaust valve opening system 300.

Many aspects and embodiments of the present disclosure are envisioned. One or more of these aspects and/or embodiments may be combined with one or more other aspects and/embodiments.

According to one aspect, an exhaust valve opening apparatus includes an elongated rocker shaft. The rocker shaft includes at least one longitudinally extending flow path connectable to a control fluid supply and to a controllable valve that is operable to pressurize the control fluid supplied by said rocker shaft to open at least one exhaust valve.

In an embodiment, the rocker shaft includes a controllable valve flow path that provides control fluid to the controllable valve from the control fluid supply. In an embodiment, the rocker shaft includes a check valve flow path that provides pressurized control fluid from the controllable valve to a check valve housed by a cam housing.

In an embodiment, the cam housing includes primary and secondary pistons in fluid communication with the check valve to receive pressurized control fluid from said check valve. The pressurized control fluid locks the primary piston so motion imparted to the primary piston by a cam lobe is transferred to the secondary piston to displace an exhaust valve.

In an embodiment, the check valve includes a primary flow path for the pressurized control fluid to flow from the controllable valve to the primary piston and a secondary flow path to bleed pressurized control fluid from the primary piston when said controllable valve is de-energized.

In an embodiment, the check valve flow path of the rocker shaft further provides pressurized control fluid from the controllable valve to a second check valve housed by the cam housing. In an embodiment, the cam housing includes a second primary piston and a second secondary piston in fluid communication with said second check valve to receive pressurized control fluid from said second check valve. The pressurized control fluid locks the second primary piston so motion imparted to the second primary piston by a cam lobe is transferred to the second secondary piston to displace a second exhaust valve.

In an embodiment, the second check valve includes a primary flow path for the pressurized control fluid to flow from the controllable valve to the second primary piston and a secondary flow path to bleed pressurized control fluid from the second primary piston when the controllable valve is de-energized.

According to another aspect, an exhaust valve opening apparatus includes a rocker shaft in fluid communication with a control fluid supply and a housing assembly including a housing around the rocker shaft. The housing assembly includes a controllable valve that is in fluid communication with the rocker shaft to receive control fluid from the rocker shaft and check valve in fluid communication with the controllable valve to receive pressurized control fluid from the controllable valve. The housing assembly also includes primary and secondary pistons in fluid communication with the check valve to receive pressurized control fluid from the check valve. In this arrangement, motion imparted to the primary piston by a cam lobe is transferred to the secondary piston to displace an exhaust valve.

In an embodiment, a second housing assembly is provided that includes a second housing around the rocker shaft that is spaced from the housing. The second housing assembly also includes a second check valve in fluid communication with the controllable valve to receive pressurized control fluid from the controllable valve through the rocker shaft, and second primary and secondary pistons in fluid communication with the second check valve to receive pressurized control fluid from the second check valve. In this arrangement, motion imparted to the second primary piston by a second cam lobe is transferred to the second secondary piston to displace a second exhaust valve.

In an embodiment, the rocker shaft includes a check valve flow path that provides pressurized control fluid from the controllable valve to the second check valve.

In an embodiment, the rocker shaft includes a controllable valve flow path that provides control fluid to the controllable valve from the control fluid supply.

In an embodiment, the apparatus includes a first annular flow passage between the housing and the rocker shaft that fluidly connects the controllable valve flow path and an inlet to the controllable valve.

In an embodiment, the apparatus includes a second annular flow passage between the housing and the rocker shaft that fluidly connects an outlet of the controllable valve, an inlet of the check valve, and the check valve flow path. The apparatus further includes a third annular flow passage between the second housing and the rocker shaft that fluidly connects the check valve flow path and an inlet of the second check valve.

In an embodiment, the apparatus includes a fourth annular flow passage between the housing and the rocker shaft that fluidly connects an outlet of the check valve and the primary and secondary pistons. The apparatus further includes a fifth annular flow passage between the second housing and the rocker shaft that fluidly connects an outlet of the second check valve and the second primary and secondary pistons.

In an embodiment, the rocker shaft includes a controllable valve flow path that provides pressurized fluid to the controllable valve from the pressurized fluid supply.

In an embodiment, the apparatus includes a first annular flow passage between the housing and the rocker shaft that fluidly connects the controllable valve flow path and an inlet to the controllable valve.

In an embodiment, the apparatus includes a second annular flow passage between the housing and the rocker shaft that fluidly connects an outlet of the controllable valve, an inlet of the check valve, and the check valve flow path.

In an embodiment, the apparatus includes a third annular flow passage between the housing and the rocker shaft that fluidly connects an outlet of the check valve and the primary and secondary pistons.

In an embodiment, the first, second, and third annular flow passages are formed by grooves in an inner surface of the housing that extends around the rocker shaft.

In an embodiment, the apparatus includes annular seals between the rocker shaft and the inner surface that fluidly isolate the first, second, and third annular flow passages from one another.

In an embodiment, a gap is formed between the rocker shaft and an inner surface of the housing that extends around the rocker shaft.

In an embodiment, the housing is mounted to at least one of a cylinder head, cam carrier, or cam cap of an engine to prevent force transfer from the housing to the rocker shaft during braking operation.

In an embodiment, the apparatus includes a plurality of seals between an inner surface of the housing and an outer surface of the rocker shaft.

In another aspect, an exhaust valve opening apparatus includes a rocker shaft in fluid communication with a control fluid supply, a first housing assembly including a first housing around the rocker shaft, and a second housing assembly including a second housing around the rocker shaft that is spaced from the first housing along the rocker shaft. The first housing assembly includes a controllable valve in fluid communication with the rocker shaft to receive control fluid from the rocker shaft, a first check valve in fluid communication with the controllable valve to receive pressurized control fluid from the controllable valve, and first primary and secondary pistons in fluid communication with the first check valve to receive pressurized control fluid from the check valve. The first housing assembly is configured to that motion imparted to the first primary piston by a first cam is transferred to the first secondary piston to displace a first exhaust valve. The second housing assembly includes a second housing around the rocker shaft that is spaced from the first housing along the rocker shaft, a second check valve in fluid communication with the controllable valve to receive pressurized control fluid from the controllable valve through the rocker shaft, and second primary and secondary pistons in fluid communication with the second check valve to receive pressurized control fluid from the second check valve. The second housing assembly is configured so that motion imparted to the second primary piston by a second cam is transferred to the second secondary piston to displace a second exhaust valve.

In an embodiment, the rocker shaft includes a controllable valve flow path that provides control fluid to the controllable valve from the control fluid supply and a check valve flow path that provides pressurized control fluid from the controllable valve to the second check valve. The rocker shaft also includes a first annular flow passage between the first housing and the rocker shaft that fluidly connects the controllable valve flow path and an inlet to the controllable valve. The rocker shaft also includes a second annular flow passage between the first housing and the rocker shaft that fluidly connects an outlet of the controllable valve, an inlet of the first check valve, and the check valve flow path. The rocker shaft also includes a third annular flow passage between the second housing and the rocker shaft that fluidly connects the check valve flow path and an inlet of the second check valve. The rocker shaft also includes a fourth annular flow passage between the first housing and the rocker shaft that fluidly connects an outlet of the first check valve and the first primary and secondary pistons. The rocker shaft also includes a fifth annular flow passage between the second housing and the rocker shaft that fluidly connects an outlet of the second check valve and the second primary and secondary pistons.

According to another aspect of the present disclosure, an exhaust valve opening apparatus includes a housing assembly including a housing positionable around a rocker shaft, a controllable valve supported on the housing, a check valve supported on the housing, a primary piston supported on the housing, and a secondary piston supported on the housing. A first flow path is defined by the housing that connects an outlet of the controllable valve to an inlet of the check valve, and a second flow path is defined by the housing that connects an outlet of the check valve to the primary and secondary pistons.

In an embodiment, the housing assembly includes a third flow path that is defined by the housing that connects an inlet of the controllable valve to an outlet of the rocker shaft to provide a control fluid to the controllable valve.

While the invention has been illustrated and described in detail in the drawings and foregoing description, the same is to be considered as illustrative and not restrictive in character, it being understood that only certain exemplary embodiments have been shown and described. Those skilled in the art will appreciate that many modifications are possible in the example embodiments without materially departing from this invention. Accordingly, all such modifications are intended to be included within the scope of this disclosure as defined in the following claims. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An exhaust valve opening apparatus, comprising:

an elongated rocker shaft including at least one longitudinally extending flow path in fluid communication with a control fluid supply and in fluid communication with a controllable valve, the controllable valve configured to receive control fluid from the rocker shaft and operable to pressurize the control fluid supplied by said rocker shaft to open at least one exhaust valve.

2. The apparatus of claim 1, wherein said rocker shaft includes a controllable valve flow path that provides control fluid to said controllable valve from said control fluid supply.

3. The apparatus of claim 2, wherein said rocker shaft includes a check valve flow path that provides pressurized control fluid from said controllable valve to a check valve housed by a cam housing.

4. The apparatus of claim 3, wherein said cam housing includes primary and secondary pistons in fluid communication with said check valve to receive pressurized control fluid from said check valve, wherein said pressurized control fluid locks said primary piston so motion imparted to said primary piston by a cam lobe is transferred to said secondary piston to displace an exhaust valve.

5. The apparatus of claim 4, wherein said check valve includes a primary flow path for the pressurized control fluid to flow from said controllable valve to said primary piston and a secondary flow path to bleed pressurized control fluid from said primary piston when said controllable valve is de-energized.

6. The apparatus of claim 3, wherein said check valve flow path of said rocker shaft further provides pressurized control fluid from said controllable valve to a second check valve housed by said cam housing.

7. The apparatus of claim 6, wherein said cam housing includes a second primary piston and a second secondary piston in fluid communication with said second check valve to receive pressurized control fluid from said second check valve, wherein said pressurized control fluid locks said second primary piston so motion imparted to said second primary piston by a cam lobe is transferred to said second secondary piston to displace a second exhaust valve.

8. The apparatus of claim 7, wherein said second check valve includes a primary flow path for the pressurized control fluid to flow from said controllable valve to said second primary piston and a secondary flow path to bleed pressurized control fluid from said second primary piston when said controllable valve is de-energized.

9. An exhaust valve opening apparatus, comprising:

a rocker shaft in fluid communication with a control fluid supply; and a housing assembly including a housing around said rocker shaft, a controllable valve in fluid communication with said rocker shaft to receive control fluid from said rocker shaft, a check valve in fluid communication with said controllable valve to receive pressurized control fluid from said controllable valve, and primary and secondary pistons in fluid communication with said check valve to receive pressurized control fluid from said check valve, wherein motion imparted to said primary piston by a cam lobe is transferred to said secondary piston to displace an exhaust valve.

10. The apparatus of claim 9, further comprising:

a second housing assembly including a second housing around said rocker shaft that is spaced from said housing, a second check valve in fluid communication with said controllable valve to receive pressurized control fluid from said controllable valve through said rocker shaft, and second primary and secondary pistons in fluid communication with said second check valve to receive pressurized control fluid from said second check valve, wherein motion imparted to said second primary piston by a second cam lobe is transferred to said second secondary piston to displace a second exhaust valve.

11. The apparatus of claim 10, wherein said rocker shaft includes a check valve flow path that provides pressurized control fluid from said controllable valve to said second check valve.

12. The apparatus of claim 11, wherein said rocker shaft includes a controllable valve flow path that provides control fluid to said controllable valve from said control fluid supply.

13. The apparatus of claim 12, further comprising a first annular flow passage between said housing and said rocker shaft that fluidly connects said controllable valve flow path and an inlet to said controllable valve.

14. The apparatus of claim 13, further comprising:

a second annular flow passage between said housing and said rocker shaft that fluidly connects an outlet of said controllable valve, an inlet of said check valve, and said check valve flow path; and a third annular flow passage between said second housing and said rocker shaft that fluidly connects said check valve flow path and an inlet of said second check valve.

15. The apparatus of claim 14, further comprising:

a fourth annular flow passage between said housing and said rocker shaft that fluidly connects an outlet of said check valve and said primary and secondary pistons; and a fifth annular flow passage between said second housing and said rocker shaft that fluidly connects an outlet of said second check valve and said second primary and secondary pistons.

16. The apparatus of claim 9, wherein said rocker shaft includes a controllable valve flow path that provides pressurized fluid to said controllable valve from said pressurized fluid supply.

17. The apparatus of claim 16, further comprising a first annular flow passage between said housing and said rocker shaft that fluidly connects said controllable valve flow path and an inlet to said controllable valve.

18. The apparatus of claim 17, further comprising a second annular flow passage between said housing and said rocker shaft that fluidly connects an outlet of said controllable valve, an inlet of said check valve, and said check valve flow path.

19. The apparatus of claim 18, further comprising a third annular flow passage between said housing and said rocker shaft that fluidly connects an outlet of said check valve and said primary and secondary pistons.

20. The apparatus of claim 19, wherein said first, second, and third annular flow passages are formed by grooves in an inner surface of said housing that extends around said rocker shaft, and further comprising annular seals between said rocker shaft and said inner surface that fluidly isolate said first, second, and third annular flow passages from one another.

21. The apparatus of claim 9, wherein a gap is formed between said rocker shaft and an inner surface of said housing that extends around said rocker shaft.

22. The apparatus of claim 9, wherein the housing is mounted to at least one of a cylinder head, cam carrier, or cam cap of an engine to prevent force transfer from the housing to the rocker shaft during braking operation.

23. The apparatus of claim 9, wherein comprising a plurality of seals between an inner surface of said housing and an outer surface of said rocker shaft.

24. An exhaust valve opening apparatus, comprising:

a rocker shaft in fluid communication with a control fluid supply;

a first housing assembly including a first housing around said rocker shaft, a controllable valve in fluid communication with said rocker shaft to receive control fluid from said rocker shaft, a first check valve in fluid communication with said controllable valve to receive pressurized control fluid from said controllable valve, and first primary and secondary pistons in fluid communication with said first check valve to receive pressurized control fluid from said check valve, wherein motion imparted to said first primary piston by a first cam is transferred to said first secondary piston to displace a first exhaust valve; and a second housing assembly including a second housing around said rocker shaft that is spaced from said first housing along said rocker shaft, a second check valve in fluid communication with said controllable valve to receive pressurized control fluid from said controllable valve through said rocker shaft, and second primary and secondary pistons in fluid communication with said second check valve to receive pressurized control fluid from said second check valve, wherein motion imparted to said second primary piston by a second cam is transferred to said second secondary piston to displace a second exhaust valve.

25. The apparatus of claim 24, wherein:

said rocker shaft includes a controllable valve flow path that provides control fluid to said controllable valve from said control fluid supply and a check valve flow path that provides pressurized control fluid from said controllable valve to said second check valve;

a first annular flow passage is provided between said first housing and said rocker shaft that fluidly connects said controllable valve flow path and an inlet to said controllable valve;

a second annular flow passage is provided between said first housing and said rocker shaft that fluidly connects an outlet of said controllable valve, an inlet of said first check valve, and said check valve flow path;

a third annular flow passage is provided between said second housing and said rocker shaft that fluidly connects said check valve flow path and an inlet of said second check valve;

a fourth annular flow passage between said first housing and said rocker shaft that fluidly connects an outlet of said first check valve and said first primary and secondary pistons; and a fifth annular flow passage between said second housing and said rocker shaft that fluidly connects an outlet of said second check valve and said second primary and secondary pistons.

26. An exhaust valve opening apparatus, comprising:

a housing assembly including a housing positionable around a rocker shaft, a controllable valve supported on said housing, a check valve supported on said housing, a primary piston supported on said housing, and a secondary piston supported on said housing, a first flow path defined by said housing that connects an outlet of said controllable valve to an inlet of said check valve and a second flow path defined by said housing that connects an outlet of said check valve to said primary and secondary pistons.

27. The apparatus of claim 26, further comprising a third flow path defined by said housing that connects an inlet of said controllable valve to an outlet of the rocker shaft to provide a control fluid to the controllable valve.

* * * * *